United States Patent [19]

Nash

[11] Patent Number: 4,893,859

[45] Date of Patent: Jan. 16, 1990

[54] CONCRETE SLAB LIFTING CLAMP

[75] Inventor: Richard C. Nash, New Prague, Minn.

[73] Assignee: Fabcon, Inc., Savage, Minn.

[21] Appl. No.: 227,768

[22] Filed: Aug. 3, 1988

[51] Int. Cl.[4] ..... B66C 1/42

[52] U.S. Cl. ..... 294/103.1; 294/81.1; 294/902

[58] Field of Search ..... 294/103.1, 81.1, 67.1, 294/902

[56] References Cited

U.S. PATENT DOCUMENTS

| | | | |
|---|---|---|---|
| 3,273,933 | 9/1966 | Jochim | 294/902 X |
| 3,894,673 | 7/1975 | Lowder et al. | 228/122 |
| 4,018,576 | 4/1977 | Lowder et al. | 51/309 R |
| 4,398,761 | 4/1983 | Hanson et al. | 294/81 R |

OTHER PUBLICATIONS

Abrasive Technology, Inc. Express Line, Copyrighted in 1988, pp. 1 through 12.

Abrasive Technology, Inc. Express Line, Price List (effective 4/1/88).

*Primary Examiner*—Margaret A. Focarino

*Assistant Examiner*—Dean J. Kramer

*Attorney, Agent, or Firm*—Vidas and Arrett

[57] ABSTRACT

A device for lifting long, heavy concrete panels including clamping heads having diamond crystals bonded to the facing region to minimize slippage at the clamp head/concrete interface.

6 Claims, 1 Drawing Sheet

CONCRETE SLAB LIFTING CLAMP

FIELD OF THE INVENTION

The device of the invention is for lifting and tilting long concrete planks or panels, and more particularly to improvements in the clamping heads of such devices.

BACKGROUND OF THE INVENTION

In the manufacture of long concrete panels on elongated casting beds, one manufacturing step involves removing of pieces of the cast concrete plank from the casting bed after the plank is cast and partially cured. A method of accomplishing this function, which was used in the prior art, was the insertion of lifting loops into the top surface of the panel. The lifting loops, formed of pieces of reinforcing bar or loops of prestressing cable, projected above the top surface of the panel. These loops could be readily engaged by hooks on the ends of cables suspended from a crane to provide for the lifting of the planks.

In casting processes where hollow core planks are manufactured by a slipform technique to form voids by temporarily filling them with aggregate, it is necessary to dump this core forming material from the planks after they are removed from the casting bed. Although this operation has been done by using lifting loops, the loops are susceptible to pulling out of the concrete during lifting. Further, the projecting portion of the lifting loops must be removed for appearance sale after installation of the plank at a construction site. Covering the remnants of lifting loops after the panel has been erected to form building walls or floors is labor intensive and tends to lead to staining as the panel weathers.

In U.S. Pat. No. 4,398,761, assigned to the same assignee as the present invention, a device for lifting and tilting concrete plank or panels is described. The device has a pair of clamping heads suspended from opposite ends of an extendable beam. The device is a significant improvement over lifting loops for lifting and tilting concrete panels. However, the very high weight of the concrete panels results in a very high torque at the interface of the concrete panel and the clamping head. Even a very slight slippage at the interface tends to cause the concrete to crack and spall. Such spalls are unsightly, and if repairable, repairs are expensive. If the spalling is severe enough, salvage of the plank may not be possible.

SUMMARY OF THE INVENTION

The improved device of the invention comprises a device utilizing a pair of clamping heads which are suspended from opposite ends of an extendable beam which has improved clamping heads. The device may be configured as shown in U.S. Pat. No. 4,398,761 which issued August 16, 1983 to Hanson et al, the disclosure of which is incorporated herein by reference. The present improvement resides in the clamping head face which contacts the side wall of the concrete panel.

Improved clamping heads are formed by incorporating diamond crystals into the face of the steel clamping head. The diamond crystals greatly increase the resistance to movement between the clamp head interface and the concrete side walls. The upper projection of the diamond crystals dig into the concrete and markedly decreases the incidence of concrete spalling by reducing slippage. Point contact of concrete to diamond rather than concrete to steel means that there is virtually no wear on the clamp head, even after extended usage.

The diamonds are applied to the face of the clamping head. The diamonds may either be applied across the entire surface of the clamp head or in a pattern which minimizes the use of diamond while insuring that the load would still be carried across diverse points on the clamp head face. One satisfactory method of applying diamonds to the face of the clamp head is described in U.S. Pat. No. 3,894,673 which issued July 15, 1975 to Lowder et al, the disclosure of which is incorporated herewith by reference.

The diamond crystals are bonded to the metal substrate of the clamp head face in a monolayer by a braze alloy if the methods of U.S. Pat. No. 3,894,673 are followed.

The presence of the diamond crystals on the surface of the clamp head does not cause any cosmetic defects on the side wall of the concrete panel. The small size of the diamond crystals involved does not mar the desired finish of the concrete.

It has been found that the improved clamp heads in accordance with the invention quickly pay for the extra cost, since spalling and other problems relating to the clamp interface forces are virtually eliminated by the improved design.

DETAILED DESCRIPTION OF THE INVENTION

Figure 1:
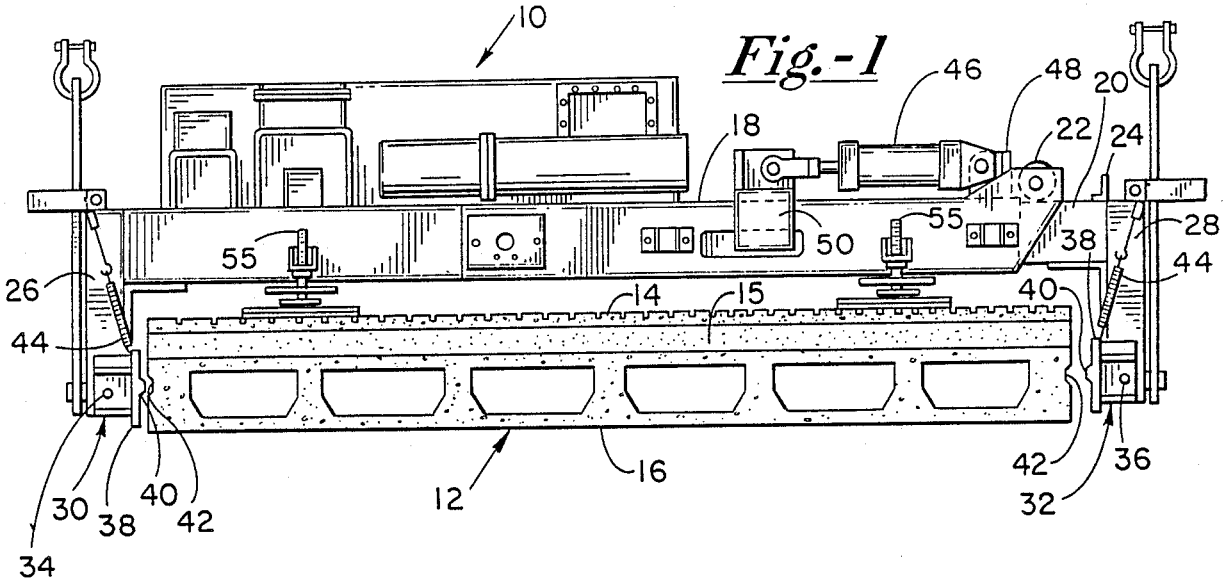
FIG. 1 is an elevation of view of a prior art suitable clamping device prior to engagement with a concrete panel.

FIG. 1 shows the clamp 10 of the prior art, especially as in U.S. Pat. 4,398,761. Clamp 10 is shown positioned above a concrete panel 12 which, in the embodiment shown, is a sandwich panel having a decorative textured top surface 14, an insulating layer 15 formed from polystyrene foam or some similar insulating material and a structured base portion 16 which is a hollow core prestressed concrete plank.

The lifting clamp arrangement is used to lift panels after they have been cast and the concrete partially cured. The apparatus will most frequently be used to remove the plank from the surface of a casting bed. However, it can also be used in lifting planks in other locales such as a storage yard. Because the lifting clamp, according to the present invention, does not project below the bottom face of the panel, the clamps can be engaged with a panel and be used to lift the same even when the panel is on a flat surface such as a truckbed or railroad flatcar.

Clamping device 10 is comprised of an extendable beam 18 comprised of an outer beam section 19 and an inner beam section 20, which is mounted for movement in and out of beam 19 along the axis of the beam. The movement of beam 20 relative to beam 19 is slidable movement which is facilitated using a roller 22 which is rotatably mounted at one end of beam 19. A stop or detent 24 is mounted on beam 20 to prevent inadvertent retraction of the entirety of beam 20 into beam 19 to avoid possible damage to the clamp or its control system.

The retractable beam 18 has downwardly projecting end portions 26 and 28 attached to beams 19 and 20, respectively. Portions 26 and 28 are not movable relative to the beam portions 19 and 20 to which they are attached, and provide a rigid support frame to which clamping heads 30 and 32 are pivotally mounted on shafts or pins 34 and 36, respectively. The face 38 of clamping heads 30 and 32 includes a projecting portion 40 which directly engages the longitudinal slot 42 of the sidewall of panel 12. The panel 12 will frequently have a sidewall which is not perpendicular to the plane of the panel. To permit face 38 of the clamping heads 30 and 32 to be positioned against the sidewall of panel 12, limited pivotal movement of the heads about pins 34 and 36 is provided relative to the downwardly depending extensions 26 and 28 of beams 19 and 20. The clamping heads are maintained in a neutral, usually vertical, orientation by springs 44 as the clamping heads are brought into alignment with the sidewalls of panel 12.

The extendable beam 20 shown in FIG. 1 is retracted by operation of a hydraulic actuator 46 which is connected to a projection 48 of beam 19 at one end and to a projection 50 of beam 20 at the other end. When actuator 46 is extended as shown, the inner beam 20 is moved from right to left to reduce the distance between the faces 38 of clamping heads 30 and 32 to thereby bring them into firm engagement with the sidewalls of panel 12. Alignment guides 55 are utilized to vertically align and level the extendable beam 18 with the top surface 14 of panel 12. The alignment guides 55 are utilized to preselect the proper vertical height of the extendable beam over the surface of panel 12. When properly positioned, the projection 40 on the face 38 of clamping heads 30 and 32 will engage the longitudinal groove 42 cast into the sidewall of panel 12 during the manufacturing step. The pivotal connection between clamping heads 30 and 32 and the downwardly projecting members 26 and 28 allows alignment of the face 38 of the clamping members with the non-vertical sidewalls of panel 12.

Figure 2:
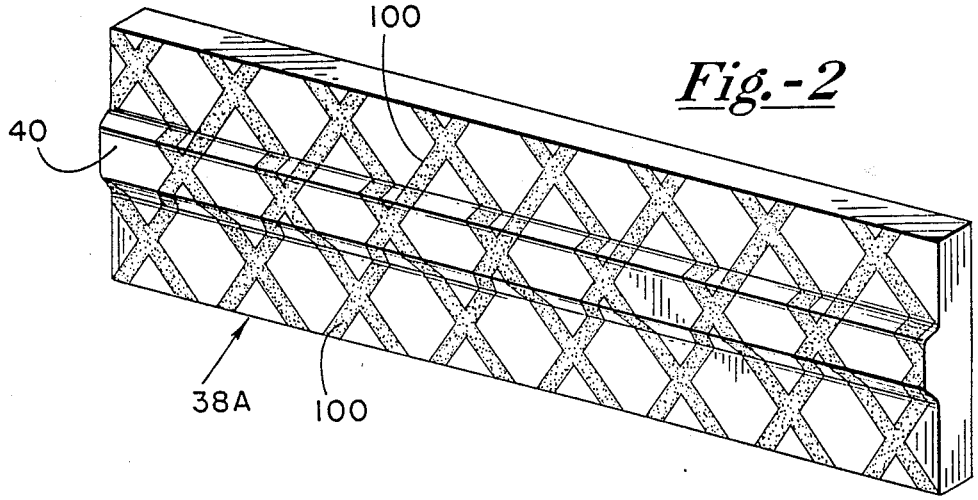
FIG. 2 is a perspective view of the invention clamping head showing the diamond crystal pattern.
Figure 3:
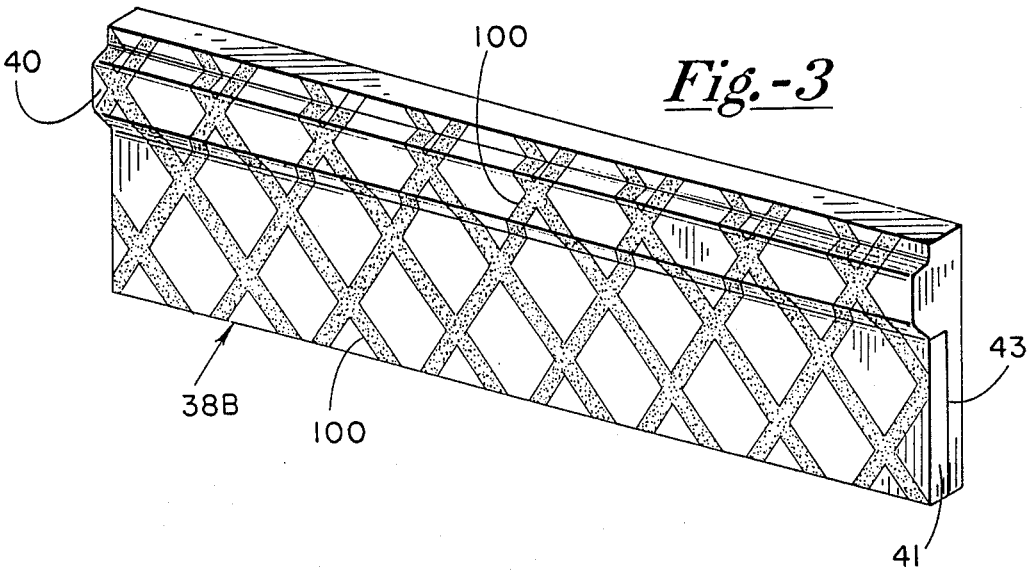
FIG. 3 is a perspective view of an alternative clamping head complete with diamond crystal pattern.

FIGS. 2 and 3 show alternative faces 38 which may be utilized on clamping head 30 and 32. In FIG. 2, face 38A includes a centrally positioned projecting portion 40. In FIG. 3, the projecting portion 40 of face 38B is located near an edge. The location of the projecting portion of the face is not critical and is shown merely to emphasize that the invention applies to all face configurations.

The outer surface of faces 38A, B include a pattern of diamond crystals 100 shown in a crisscrossing or diamond pattern. The diamond crystals 100 are bound to the steel face 38 A,B. A satisfactory method of bonding the diamond crystals 100 to a face 38 is described in U.S. Pat. No. 3,894,673. This patent describes brazing of diamond to the substrate surface. A monolayer of diamond crystals are bonded to the clamp head faces 38A, B with a braze alloy according to that patent.

Although shown in a cross-hatch pattern, diamond crystals 100 may be applied across the entire outer surface of a clamp head face. Greater coverage of the face would provide somewhat better holding power but substantially increases cost. Any pattern could be utilized so long as diamond crystals are bonded to the outer surface of the face 38 at diverse points to distribute the load over a wider area. Even widely separated, discrete spots of diamond crystals 100 on the face 38 would provide superior performance over faces without diamond crystals.

The diamond coated surfaces may include a preselected part of face 38. For example, the portion of face 38, 38A and 38B below the key 40 may be wholly or partly diamond coated. The concrete at the lower part of plank 16 backs up the outer lower edges of the vertically oriented sides. This backing permits high compression loads by members 38 to aid in obtaining a slip free mating In a preferred form, the diamond coated face can be a portion 41 welded, as at 43, onto element 38. Such a construction provides economies in manufacture and replacement.

The sizes of the diamond crystals can vary greatly, since the holding power supplied by the diamond does not vary greatly with crystal size. Since the concrete does not present an extremely smooth surface, even relatively large diamond crystals may be used without undo marring of the desired concrete finish. Generally, a size in the range of 100/120 mesh diamond crystals are preferred.

The inventive clamps of the invention complete with the diamond crystals bonded to the clamp faces greatly decreases damage to the concrete panels during handling. The point contact of diamond crystal to concrete greatly reduces any possibility of slippage at the clamp-/concrete interface.

What is claimed is:

1. In an apparatus for lifting concrete panels, said apparatus including two or more lifting clamps, each of which comprises: a first beam; a second beam; a first clamping head connected to said first beam; said first clamping head constructed and arranged to engage said panel on one sidewall thereof; a second clamping head connected to said second beam, said second clamping head constructed and arranged to engage said panel on an opposite sidewall thereof; means for moving said first beam relative to said second beam to selectively engage and disengage one or both of said clamping heads from the sidewall of said panel; and connection means connected to said apparatus and constructed and arranged for connection to a lifting cable, said connection means providing for pivotal movement of said apparatus and said first and second clamping heads about an axis through said panel below said beams, the improvement comprising: each of said clamping heads including diamond crystals bonded to a panel engaging face of said clamping head wherein said diamond crystals are bonded to said clamping head by a braze alloy in a monolayer of crystals positioned at diverse points on said clamping head faces so as to distribute the points at which a load may be applied to said clamping heads.

2. In an apparatus for lifting concrete panels, said apparatus including two or more lifting clamps, each of which comprises; a first beam; a second beam; a first clamping head connected to said first beam; said first clamping head constructed and arranged to engage said panel on one sidewall thereof; a second clamping head connected to said second beam, said second clamping head constructed and arranged to engage said panel on an opposite sidewall thereof; means for moving said first beam relative to said second beam to selectively engage and disengage one or both of said clamping heads from the sidewall of said panel; and connection means connected to said apparatus and constructed and arranged for connection to a lifting cable, said connection means providing for pivotal movement of said apparatus and said first and second clamping heads about an axis through said panel below said beams, the improvement comprising: each of said clamping heads including diamond crystals bonded to a panel engaging face of said clamping head wherein said clamping head faces include a cross-hatched pattern of a monolayer of diamond crystals bonded to said faces.

3. Apparatus for suspension from lifting cables depending from an overhead crane, said apparatus constructed and arranged to lift and tilt concrete panels, said apparatus including two or more lifting clamps, each of which comprises:

a pair of extendable beams;

a pair of clamping heads, each of which is suspended from one end of each of said pair of extendable beams, each one of said pair of clamping heads constructed to engage said panel on a sidewall thereof, each of said clamping heads including diamond crystals bonded to a panel engaging face of said clamping head;

connection means connected to said apparatus and said lifting cable, said connection means providing for pivotal movement of said apparatus and said pair of clamping heads about an axis through said panel below said pair of expandable beams; and means for extending and retracting said pair of extendable beams relative to each other to position said pair of clamping heads to grip said panel on adjacent sides wherein said diamond crystals are bonded to said clamping head faces at a plurality of diverse points of said faces in a cross-hatched pattern to distribute the point contact load to said faces;

4. Apparatus for suspension from lifting cables depending from an overhead crane, said apparatus constructed and arranged to lift and tilt concrete panels said apparatus including two or more lifting clamps, each of which comprises:

first and second beams, each of which has a clamping head suspended from one end thereof for engagement with opposite sidewalls of said panel; each of said clamping heads including a monolayer of diamond crystals bonded by a braze alloy to a panel engaging face to said clamping head;

means connected between said first beam and the other end of said second beam for elevating the end of second beam relative to said first beam to selectably pivot said second beams and clamping head suspended from it into and out of engagement with sidewalls of said panel; and connection means connected to said apparatus and said lifting cable, said connection means providing for pivotal movement of said apparatus and said clamping heads about an axis through said panel below said first and second beams.

5. The apparatus of claim 4 wherein said diamond crystals are bonded to said faces in a cross-hatched pattern.

6. A clamping head for use in apparatus for lifting concrete panels, said clamping head being constructed and arranged to engage a concrete panel on one sidewall of said panel, said clamping head further including a plurality of diamond crystals bonded in a monolayer to a panel engaging face of said clamping head wherein said diamond crystals are bonded to said faces in a cross-hatched pattern.

* * * * *